US008568583B2

(12) United States Patent
Colyar

(10) Patent No.: US 8,568,583 B2
(45) Date of Patent: Oct. 29, 2013

(54) HIGH CONVERSION PARTIAL UPGRADING PROCESS

(76) Inventor: James J. Colyar, Newtown, PA (US)

( * ) Notice: Subject to any disclaimer, the term of this patent is extended or adjusted under 35 U.S.C. 154(b) by 917 days.

(21) Appl. No.: 12/655,242

(22) Filed: Dec. 28, 2009

(65) Prior Publication Data

US 2011/0155639 A1 Jun. 30, 2011

(51) Int. Cl.
*C10G 47/00* (2006.01)

(52) U.S. Cl.
USPC ..... 208/58; 208/309

(58) Field of Classification Search
USPC ..... 208/95, 58, 309
See application file for complete search history.

(56) References Cited

U.S. PATENT DOCUMENTS

| | | | | |
|---|---|---|---|---|
| 7,815,870 | B2 * | 10/2010 | Lott et al. | 422/187 |
| 2007/0034550 | A1 | 2/2007 | Hedrick et al. | |
| 2008/0011643 | A1 * | 1/2008 | Lenglet et al. | 208/58 |
| 2008/0078552 | A1 * | 4/2008 | Donnelly et al. | 166/303 |
| 2008/0289999 | A1 * | 11/2008 | Lenglet | 208/309 |

* cited by examiner

*Primary Examiner* — Randy Boyer
*Assistant Examiner* — Juan Valencia

(57) ABSTRACT

The described invention discloses an innovative hydroconversion-processing configuration for converting bitumen or heavy oils to produce a transportable synthetic crude oil (SCO). The innovative processing scheme disclosed herein maximizes the synthetic crude oil yield at a minimal investment compared to currently known methods.

9 Claims, 1 Drawing Sheet

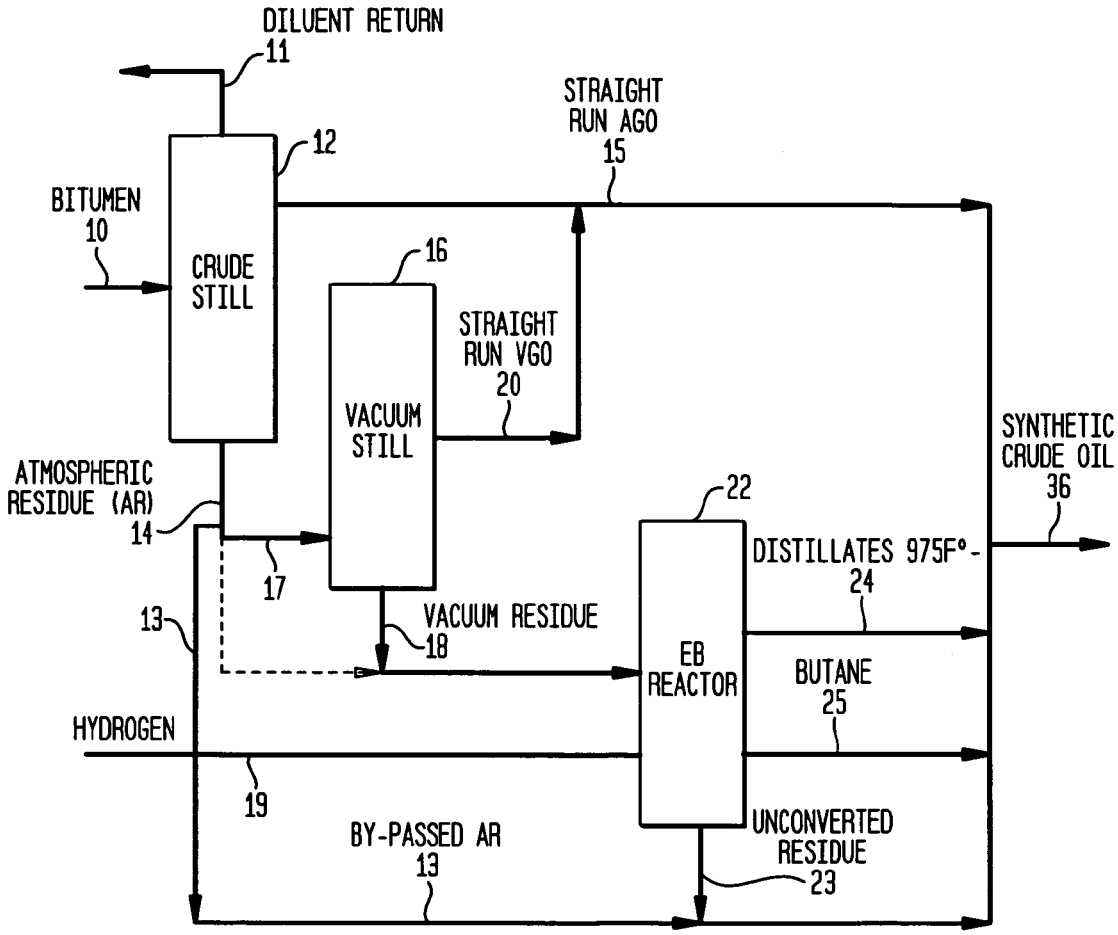
DILUENT RETURN
11
12
STRAIGHT
RUN AGO
15
BITUMEN
10
CRUDE
STILL
16
STRAIGHT
RUN VGO
20
VACUUM
STILL
SYNTHETIC
CRUDE OIL
36
ATMOSPHERIC
RESIDUE (AR)
14
22
DISTILLATES 975F°-
24
17
13
VACUUM RESIDUE
18
EB
REACTOR
BUTANE
25
HYDROGEN
19
BY-PASSED AR
13
UNCONVERTED
RESIDUE
23

HIGH CONVERSION PARTIAL UPGRADING PROCESS

FIELD OF THE INVENTION

The described invention discloses an innovative hydroconversion processing configuration for converting bitumen or heavy oils to produce a transportable synthetic crude oil (SCO). The innovative processing scheme disclosed herein maximizes the SCO yield at a minimal investment compared to currently known methods. SCO is the primary product from a bitumen/extra heavy oil upgrader facility and is typically associated with oil sands production.

SCO can also be the output from an oil shale extraction process. The properties of the synthetic crude depend to a large extent on the feedstock quality and on the processes used in the upgrading. Relative to the feedstock, SCO is lower in sulfur, has API gravity in the range of 20° to 35°, and is also known as "upgraded crude".

The total heavy oil or bitumen feedstock is initially fractionated in a crude still to produce straight-run atmospheric gas oil (AGO), atmospheric residue (AR), and the light diluent which is used to transport the bitumen or heavy oil from the field. The diluent is returned to the field. A portion of the AR stream is sent to a vacuum still to produce straight run vacuum gas oil (VGO) and a vacuum residue feedstream. A portion of the AR may also be sent directly to the conversion unit. The vacuum residue feedstream and/or a portion of the atmospheric residue feedstream are thereafter processed along with a hydrogen stream in an ebullated-bed reactor system operating at relatively high severity conditions to produce a greater than seventy (70%) percent conversion rate of the vacuum residue. The ebullated-bed products, including distillates and unconverted vacuum residue, are thereafter blended with the heavy oil or bitumen AR which was bypassed and the fractionated straight run distillates (AGO and VGO) to produce the final SCO product.

Once the level of severity (primarily vacuum residue conversion level) in the ebullated-bed unit is set, the fraction of the heavy oil or bitumen AR that bypasses the vacuum fractionation and conversion unit can be set to attain the required final SCO qualities. Hydrogen for the ebullated-bed unit can be obtained via a natural gas-steam reformer or via gasification of a portion of the ebullated-bed heavy product or straight run vacuum residue. The invention results in a high yield of specification SCO, no undesirable bottoms or coke product and is accomplished with minimal investment and operating costs. Unlike much of the SCO commercially produced, the invention SCO will contain both straight run and conversion vacuum residue. The SCO will be stable as a result of the selection of optimal operating conditions in the ebullated-bed conversion unit and the proper blending technique to combine the bypassed bitumen/heavy oil AR and the conversion products.

BACKGROUND OF THE INVENTION

The world's higher quality light natural crude oils are those generally having an API gravity greater than 30° with sulfur content less than 0.5 percent. These high quality light natural crudes cost the least to refine into a variety of highest value end products including petrochemicals and therefore command a price premium. More important, however, world refinery capacity is geared to a high proportion of light natural crude oils with an API of 30° or higher.

It is generally accepted that world supplies of light crude oils recoverable by the conventional means of drilling wells into reservoirs and the use of nature's pressure, or by pumping to recover the oil, will be diminished to the extent that in the coming decades these supplies will no longer be capable of meeting the world demand.

To find relief from oil supply shortage it will be necessary to substantially increase processing of the vast world reserves of coal and viscous oil, bitumens in tar sands and kerogens in oil shale. These sources of crude oil remain largely unexploited today although recovery of oil from tar sands is in practice in Canada. The development of technology for the production of synthetic oil as an alternative to the light crude oil found in nature continues to be plagued by the large capital investments required in recovery and production facilities and a long wait for return on investment. In addition, large expenditures are required to construct or retrofit refineries for synthetic oils recovered from heavy oils and bitumens. In addition, present synthetic oil plants for processing heavy oils, or bitumens from tar sands, have focused more on the development of systems for recovery and production than on energy efficiency, maximization of yield and high environmental processing standards. Except for South Africa's Sasol process, which benefits from low cost labor used in coal mining, straight coal liquefaction is not yet cost competitive with synthetic oil produced from tar sands bitumen or heavy oils.

It is therefore of considerable importance that methods are found to produce synthetic crudes to replace the rapidly depleting reserves of light natural crudes available from conventional sources and at a cost at least approaching these crudes and competitive with the crudes being recovered at higher cost from under the sea or from frontier areas such as the extreme north with its rigorous climate. It is also important that synthetic crudes are comprised in desired proportions of a mixture of aromatic, naphthenic and paraffinic components as these three families of compounds comprise essential feedstock to refinery capacity producing today's transportation fuels and feedstocks for the petrochemical industry.

Accordingly, applicants have disclosed an invention which is an innovative hydroconversion processing configuration for converting these heavy oils and/or bitumens to produce a transportable synthetic crude oil. In the invention, the atmospheric residue from the heavy oil or bitumen feedstock is only partially processed in the hydroconversion unit, there is no secondary hydrotreating nor is there any heavy unconverted residue or coke to dispose of using this novel process.

The entire heavy oil or bitumen feedstock is first fractionated in a crude still and thereafter a portion of the straight run atmospheric and/or vacuum residue created in the fractionation process is fed to an ebullated-bed hydroconversion reactor along with a hydrogen stream. The ebullated-bed reactor operates at relatively high severity and gives a conversion rate of greater than seventy (70%) percent. The converted products (975° F.) from the ebullated-bed reactor is thereafter mixed with straight-run distillates, by-passed heavy oil, bitumen atmospheric residue, and unconverted vacuum residue to create the final synthetic crude product.

These and other features of the present invention will be more readily apparent from the following description with reference to the accompanying drawing.

SUMMARY OF THE INVENTION

An objective of the invention is to provide an innovative processing configuration for maximizing feedstock capacity and liquid SCO yield at minimal required investment.

Another objective of the invention to allow the processing of bitumen or heavy oil with no net bottoms product (residue, coke) which can present a disposal problem.

It is a further objective of the present invention to utilize a maximum size and throughput ebullated-bed reactor for maximum total heavy oil or bitumen feedrate and SCO production. It is another object of the present invention to effectively blend the high conversion ebullated-bed unconverted residue and straight run heavy oil or bitumen so as to ensure the stability of final SCO product.

It is yet another object of the present invention to utilize this innovative configuration and substantially increase the efficiency of a processing system relative to traditional bitumen or heavy crude processing.

The heavy oil or bitumen feedstock is initially fractionated in crude still to produce straight-run AGO, atmospheric residue, and diluent which is returned to the field. The diluent is added to the raw bitumen at the field in order to transport the blend to the processing complex. A portion of the atmospheric residue is then sent to a vacuum still for further fractionation and the production of a straight run VGO and a vacuum residue stream. The vacuum residue feedstream and/or the atmospheric residue feedstream is thereafter processed along with a hydrogen stream in an ebullated-bed reactor system operating at relatively high severity conditions to produce a greater than seventy (70%) percent conversion rate. Multiple ebullated-bed reactors may be operated in series in accordance with this invention. The ebullated-bed products are thereafter blended with the atmospheric residue which was by-passed and the straight run distillates (VGO and AGO) to produce a stable and compatible synthetic crude oil.

Once the level of severity in the ebullated-bed unit is set, the fraction of the straight run atmospheric residue that bypasses the vacuum fractionation and conversion unit can be set to attain the required final SCO qualities. Hydrogen for the ebullated-bed unit can be obtained via a natural gas-steam reformer or via gasification of a portion of the ebullated-bed heavy product or straight run vacuum residue. The invention results in a high yield of specification SCO, no undesirable bottoms or coke product and is accomplished with minimal investment and operating costs.

More particularly, the present invention describes a novel process configuration for converting of heavy oil or bitumen feedstocks to high value, transportable synthetic crude oil comprising:

a) feeding a bitumen or heavy oil feedstock to an atmospheric fractionator to provide an atmospheric residue stream, a straight run atmospheric gas oil stream and a diluent stream used for transportation; and b) feeding a portion of said atmospheric residue stream to a vacuum fractionator to create a vacuum residue stream and a straight run vacuum gas oil stream; and c) feeding the vacuum residue stream and some or none of the atmospheric residue stream that was not processed in the vacuum fractionator in step b), along with a hydrogen stream to an ebullated-bed reactor system to create an unconverted residue stream, a full range distillate product stream, and a recovered butanes stream; and d) blending a portion of the atmospheric residue stream that was not processed in the vacuum still of step b) or the ebullated-bed reactor system of step c) with the unconverted residue from the ebullated-bed reactor system of step c); and e) blending the stream from step d) with the straight run atmospheric gas oil stream, straight run vacuum gas oil stream, the full range distillate product stream and the recovered butanes stream from the ebullated-bed reactor system to produce a transportable synthetic crude oil product.

In a preferred embodiment the heavy oil or bitumen feedstream has the following properties: API gravity less than 15°, sulfur content greater than 3 W % and vacuum residue content greater than 35%. In a preferred embodiment, a portion of the atmospheric residue stream bypasses the vacuum still and is fed to the ebullated bed unit along with the vacuum residue stream. In a preferred embodiment, between 10 and 80 percent of the straight run atmospheric residue is bypassed. In a preferred embodiment, a portion of the straight run AGO or VGO streams or the ebullated-bed distillates are not included in the synthetic crude. In another preferred embodiment, the gas oils are hydrotreated or hydrocracked prior to be blended into the synthetic crude oil.

The ebullated-bed reactor operates at the following range of conditions: reactor total pressure of 1,500 to 3,000 psia, reactor temperature of 750 to 850° F., hydrogen feedrate of 1,500 to 10,000 SCF/Bbl, liquid hourly space velocity of 0.1 to 1.5 $hr^{-1}$, and a daily catalyst replacement rate of 0.1 to 1.0 lb/Bbl of feedstock.

Generally such hydroprocessing is in the presence of catalyst containing group VI or VIII metals such as platinum, molybdenum, tungsten, nickel, cobalt, etc., in combination with various other metallic element particles of alumina, silica, magnesia and so forth having a high surface to volume ratio. More specifically, catalyst utilized for hydrodemetallation, hydrodesulfurization, hydrodenitrification, hydrocracking etc., of heavy oils and the like are generally made up of a carrier or base material; such as alumina, silica, silicaalumina, or possibly, crystalline aluminosilicate, with one more promoter(s) or catalytically active metal(s) (or compound(s)) plus trace materials. Typical catalytically active metals utilized are cobalt, molybdenum, nickel and tungsten; however, other metals or compounds could be selected dependent on the application.

The ebullated-bed reactor system maybe comprised of one, two or three stages in series and may incorporate phase separation between the reactor stages to offload the gas from the first stage reactor.

In the process according to the invention, the overall conversion percentage of the feedstream processed in the ebullated-bed reactor hydrocarbon feedstream is preferably greater than 50% wt, and more preferably greater than 70%, and even more preferably greater than 75%.

BRIEF DESCRIPTION OF THE DRAWINGS

FIG. 1 is a schematic flowsheet of the high conversion partial upgrading process of heavy oil or bitumen feedstock.

DETAILED DESCRIPTION OF THE INVENTION

The heavy oil or bitumen stream 10 enters the plant battery limits. Typically, this stream contains 10-40% light diluent which is used to transport the bitumen from the field to the processing complex. The heavy oil or bitumen feedstream is first processed through a crude atmospheric fractionator 12 to create a atmospheric residue stream 14 nominally boiling above 650° F., a straight run atmospheric gas oil stream 15, and a light diluent stream 11 which is returned to the field. The atmospheric fractionator 12 is also referred to as an atmospheric or crude still. As shown in the drawing, a portion of the atmospheric residue stream 14 bypasses the downstream processing steps and is blended with the ebullated-bed unconverted vacuum residue 23 with eventual disposition into the final synthetic crude oil product 36. The portion that bypasses the downstream processing steps is referred to in the drawing as 13.

Another portion 17 of the atmospheric residue stream 14 from the crude atmospheric fractionator 12 is thereafter sent to a vacuum fractionator 16 to create a vacuum residue stream 18 nominally boiling above 975° F. and a straight run vacuum gas oil (VGO) stream 20 nominally boiling between 650° F. and 975° F. The vacuum fractionator is also referred to as a vacuum still. As shown as a dotted line in the drawing, a portion of the atmospheric residue stream 14 may be sent directly to the ebullated-bed reactor system 22. As mentioned above, multiple ebullated-bed reactors may be operated in series in accordance with this invention. The straight run VGO stream 20 is thereafter routed together with the straight run AGO stream 15 and routed for blending to the final SCO product 36.

The vacuum residue stream 18 is thereafter combined with a hydrogen stream 19 and sent to the residue ebullated-bed reactor system 22 for hydroconversion. The hydrogen stream 19 can be obtained via steam methane reforming of natural gas or gasification of a suitable heavy process stream. As mentioned above, a portion of the atmospheric residue stream 14 may be directly sent to the ebullated-bed reactor system 22.

The ebullated-bed reactor system 22 utilizes one or more high conversion ebullated-bed reactors in series, although only one is shown in this drawing. The vacuum residue stream 18 is hydrocracked and hydrogenated in the ebullated-bed reactor(s) 22. After product separation and fractionation; a distillate product stream 24 nominally boiling below 975° F., an unconverted residue stream 23, and a recovered butanes stream 25 are produced. The distillate product stream 24 is combined with the straight run VGO stream 20, the recovered butanes stream 25, and the straight run AGO stream 15 and thereafter sent to SCO blending 36. The unconverted residue stream 23 is combined with the atmospheric residue 13 stream that bypassed the vacuum fractionators 16 and the ebullated-bed reactor system 22 are thereafter routed and blended to create the final synthetic crude oil product 36. The combination of streams 15, 20, 23, 24, 25 and 13 forms the final SCO product.

This invention will be further described by the following example, which should not be construed as limiting the scope of the invention.

EXAMPLE 1

A total of 100,000 BPSD of bitumen is processed utilizing the novel configuration disclosed herein. Inspections on the bitumen feedstock are shown in Table 1. The 100,000 BPSD flowrate and bitumen inspections are net of the light diluent which is used to transport the heavy feedstock from the field. The objective of the processing configuration is to produce a maximum yield of stable, transportable SCO meeting Canadian pipeline specifications. These specifications are API Gravity greater than 19° and a 7° C. viscosity less than 350 cSt. The amount of bypassed bitumen atmospheric residue is determined by attaining the partially upgraded SCO specifications. In this example, 100 KBPSD of total crude were processed in the crude still, 76.5% of the atmospheric residue is sent to vacuum fractionation and 23.5% of the atmospheric residue bypasses the processing units and is blended with the ebullated-bed unconverted residue and eventually routed to final SCO. The crude still also produces 17,600 BPSD of AGO.

Based on the iterative calculation, 63,000 BPSD of the 82,400 BPSD of total atmospheric residue from the bitumen is routed to the vacuum still to produce VGO and a vacuum residue. The other portion of the atmospheric residue (19,400 BPSD) bypasses the vacuum still and is blended with the ebullated-bed unconverted residue and eventually routed to final SCO blending. The straight run AGO (17,600 BPSD) and VGO (21,200 BPSD) are routed for blending into the final SCO product. Flowrates of the major streams are shown in Table 2.

Vacuum residue from the vacuum still is thereafter sent to a high conversion ebullated-bed hydroconversion unit. The feedrate to the ebullated-bed unit is 41,900 BPSD and is near the maximum rate for a single train, two stage ebullated-bed unit with a specified maximum reactor size. This reactor size is normally limited by either fabrication or transportation constraints. The vacuum residue ebullated-bed of this example operates at a residue conversion level of greater than 75%, which has been demonstrated for Western Canadian heavy oils and bitumen feedstocks. The liquid product yields from the ebullated-bed unit are shown in Table 2 and sum to 44,800 BPSD, 7% higher than the 41,900 BPSD feedrate as a result of volume expansion due to hydrogenation.

The unconverted ebullated-bed vacuum residue rate is 6.4 KBPSD and is immediately blended with the 19.2 KBPSD of bypassed straight run atmospheric residue to insure that the mixture is stable. The straight bitumen residue has been demonstrated to be an excellent solvent for maintaining stability of high conversion ebullated-bed unconverted residue. The total hydrogen consumption in the ebullated-bed reactor unit is 78.9 mM SCFD and can be obtained via steam methane reforming or gasification of a suitable heavy process stream.

The final SCO product is a blend of the bypassed straight run atmospheric residue, the overheads from the distillation units (AGO and VGO), the full range ebullated-bed products and all available butanes. Table 3 shows the components of the final SCO blend and important inspections; the heavy crude feedstock used for the example is also shown for comparison. The SCO rate is 103.9 KBPSD with 20.0° API gravity and 2.3 W % sulfur. The typical Canadian pipeline viscosity is met. The SCO contains 17.6 V % material boiling greater than 975° F., compared to 50.6 V % in the heavy crude. The SCO liquid yield as a percentage of the crude rate is 103.9 V %.

TABLE 1

Feed Inspections

| Stream | Bitumen |
|---|---|
| Gravity, ° API | 9.3 |
| Sulfur, W % | 4.3 |
| Nitrogen, W % | 0.40 |
| Conradson Carbon Residue, W % | 13.6 |
| Distillation, V % | |
| IBP-350° F. | 0 |
| 350-650° F. | 17.6 |
| 650-975° F. | 31.8 |
| 975° F.+ | 50.6 |

TABLE 2

Summary of Flowrates
Basis: 100 KBPSD of Undiluted Bitumen

| Stream | Flowrate, kBPSD |
|---|---|
| Bitumen to Crude Still | 100.0 |
| AGO to SCO Blending | 17.6 |
| Total Atmospheric Residue | 82.4 |
| Atmospheric Residue Bypassed | 19.4 |

TABLE 2-continued

| Summary of Flowrates<br>Basis: 100 KBPSD of Undiluted Bitumen | |
|---|---|
| Stream | Flowrate, kBPSD |
| Atmospheric Residue to Vacuum Still | 63.0 |
| VGO to SCO Blending | 21.2 |
| Vacuum Residue to Ebullated-Bed Unit | 41.9 |
| Ebullated-Bed Products | 44.8 |
| Naphtha | 8.1 |
| Diesel | 13.5 |
| VGO | 16.8 |
| Unconverted Residue | 6.4 |
| Total SCO (Including Butanes) | 103.9 |
| Hydrogen Required, MMSCFD | 78.9 |

TABLE 3

| SCO Yield | | | |
|---|---|---|---|
| | Units | Feed | SCO |
| Total | BPSD | 100,000 | 103,860 |
| Yield on Crude | V % | — | 103.86 |
| Gravity | ° API | 9.3 | 20.0 |
| Sulfur | W % | 4.29 | 2.31 |
| Nitrogen | W % | 0.40 | 0.31 |
| Conradson Carbon Residue | W % | 13.6 | 6.2 |
| Nickel + Vanadium | Wppm | 290 | 100 |
| Distillation | | | |
| $C_4$-350° F. | V % | — | 8.7 |
| 350-650° F. | V % | 17.6 | 30.0 |
| 650-975° F. | V % | 31.8 | 43.7 |
| 975° F.+ | V % | 50.6 | 17.6 |
| Viscosity @ 7° C. | cSt | — | <350 |

The invention described herein has been disclosed in terms of specific embodiments and applications. However, these details are not meant to be limiting and other embodiments, in light of this teaching, would be obvious to persons skilled in the art. Accordingly, it is to be understood that the drawings and descriptions are illustrative of the principles of the invention, and should not be construed to limit the scope thereof.

I claim:

1. A novel process configuration for converting of heavy oil or bitumen feedstocks to high value, transportable synthetic crude oil comprising:

a) feeding bitumen or heavy oil feedstock having an API gravity less than 15°, sulfur content of greater than 3 weight percent and a vacuum residue content of greater than thirty five weight percent to an atmospheric fractionator to provide an atmospheric residue stream, a straight run atmospheric gas oil stream and a diluent stream: and b) feeding a portion of said atmospheric residue stream to a vacuum fractionator to create a vacuum residue stream and a straight run vacuum gas oil stream; and c) feeding the vacuum residue stream and some or none of the atmospheric residue stream that was not processed in the vacuum fractionator in step b), along with a hydrogen stream to an ebullated-bed reactor system to create an unconverted residue stream, a full range distillate product stream, and a recovered butanes stream; and d) blending the atmospheric residue stream that was not processed in the vacuum fractionator of step b) or the ebullated-bed reactor system of step c) with the unconverted residue from the ebullated-bed reactor system of step c); and e) blending the stream from step d) with the straight run atmospheric gas oil stream, straight run vacuum gas oil stream, the full range distillate product stream and the recovered butanes stream from the ebullated-bed reactor system to produce a transportable synthetic crude oil product having at least a 19° API gravity and a viscosity at 7° C. less than 400 cSt.

2. The process of claim 1 wherein the overall conversion percentage in step c) is greater than 70% wt.

3. The process of claim 1 wherein the overall conversion percentage in step c) is greater than 75% wt.

4. The process of claim 1 wherein the hydrogen stream from step c) is obtained via steam methane reforming or gasification of a suitable heavy process stream.

5. The process of claim 1 wherein a portion of the atmospheric residue stream from step a) bypasses step b) and is fed into the ebullated-bed reactor of step c) along with the vacuum residue and hydrogen streams.

6. The process of claim 1 where between 10 and 80 percent of the straight run atmospheric residue is bypassed.

7. The process of claim 1 where a portion of the straight run AGO or VGO streams or the ebullated-bed distillates are not included in the synthetic crude.

8. The process of claim 1 where the gas oils are hydrotreated or hydrocracked prior to be blended into the synthetic crude oil.

9. The process of claim 1 wherein more than one ebullated-bed reactor is utilized in step c).

* * * * *